US005563386A

United States Patent [19]

Powell et al.

[11] Patent Number: 5,563,386

[45] Date of Patent: Oct. 8, 1996

[54] ELEVATOR DISPATCHING EMPLOYING REEVALUATION OF HALL CALL ASSIGNMENTS, INCLUDING FUZZY RESPONSE TIME LOGIC

[75] Inventors: Bruce A. Powell, Canton; Jannah Stanley, Cromwell, both of Conn.; Hideyuki Honma, Kawasaki, Japan

[73] Assignee: Otis Elevator Company, Farmington, Conn.

[21] Appl. No.: 264,393

[22] Filed: Jun. 23, 1994

[51] Int. Cl.[6] ..... B66B 1/18

[52] U.S. Cl. ..... 187/382; 187/387

[58] Field of Search ..... 187/383, 387, 187/380, 382, 388, 389

[56] References Cited

U.S. PATENT DOCUMENTS

| | | | |
|---|---|---|---|
| 3,682,275 | 8/1972 | Loshbough et al. | 187/29 |
| 4,760,896 | 8/1988 | Yamaguchi | 187/124 |
| 5,022,498 | 6/1991 | Sasaki et al. | 187/127 |
| 5,146,053 | 9/1992 | Powell et al. | 187/127 |
| 5,338,904 | 8/1994 | Powell et al. | 187/137 |
| 5,427,206 | 6/1995 | Powell et al. | 187/387 |
| 5,467,844 | 11/1995 | Powell et al. | 187/387 |

FOREIGN PATENT DOCUMENTS

| | | | |
|---|---|---|---|
| 1203187 | 8/1989 | Japan | B66B 1/18 |
| 2215488 | 9/1989 | United Kingdom | B66B 1/20 |
| 2245998 | 1/1992 | United Kingdom | B66B 1/20 |

*Primary Examiner*—Robert Nappi

[57] ABSTRACT

An elevator car call is reassigned if a different car fortuitously shows up first, or if the assigned car leaves the group. The call is reassigned, one time only, if the assigned car is delayed by more than a threshold, or under certain circumstances, if the car is fully loaded without an intervening car call or the call has been waiting for more than a threshold time. The circumstances are that the weighted summation of membership values in fuzzy sets, indicating the degree to which the predicted waiting time for the currently assigned call is deemed long, the response time for a new call assignment is deemed small, and the improvement from switching the hall call assignment is deemed great, exceeds a threshold and each of the membership values exceeds its own corresponding threshold.

14 Claims, 6 Drawing Sheets

MEMBERSHIP FUNCTION FOR PWT IS LONG

MEMBERSHIP FUNCTION FOR {RRT IS SMALL}

MEMBERSHIP FUNCTION FOR
IMPROVEMENT IS GREAT

MEMBERSHIP FUNCTIONS FOR AFFECTED–ELDERLY–CALL

ELEVATOR DISPATCHING EMPLOYING REEVALUATION OF HALL CALL ASSIGNMENTS, INCLUDING FUZZY RESPONSE TIME LOGIC

TECHNICAL FIELD

This invention relates to dispatching elevator cars to respond to hall calls assigned thereto by a process involving reevaluation of unanswered hall call assignments according to criteria including fuzzy logic expressions of expected time for the cars to respond to the calls.

BACKGROUND ART

The assignment of elevator car calls as soon as they are registered, so as to permit persons to queue in front of the hoistway door of the car which is expected to answer the call, and to provide reassurance to passengers, is typically made in response to predictions. In commonly owned copending U.S. Pat. No. 5,427,206, assignment of hall calls is based upon the car which is predicted to get there most quickly, unless it causes other calls to become "elderly"(or more so); the term "elderly" meaning that it has been predicted that the call would not be answered in a minute or less. The problem with the system of the aforementioned application is that even though a car could answer the call in question extremely quickly (for instance, in less than 10 seconds), if such assignment would cause the predicted response to any other call to advance from 59 to 60 seconds, or from 61 to 62 seconds, thereby either causing it to become elderly or more elderly, that car would not get the assignment; this is true even if all of the remaining assignments might take 40 or more seconds and would cause calls to have to wait 57 or 59 seconds. In such a circumstance, obviously the first car would be a better assignment than any of the others, but such an assignment would not be made. Better hall call assignments are provided in the method of a commonly owned copending U.S. patent application entitled "Elevator Dispatching Employing Hall Call Assignments Based on Fuzzy Response Time Logic" U.S. Ser. No. 08/264,842, filed contemporaneously herewith. However, when hall call assignments are made early in the life of the call, there is significant opportunity for delaying the assigned car as it proceeds through a variety of service events toward the call. Such delays may commonly be caused by an unusually large number of exiting or entering passengers, holding doors open during conversations, and the like.

In instantaneous car assignment protocols, the theory is that the assignment should never be changed to a different car after the assignment to a particular car is announced, because passengers are required to move to a new car and, in some cultures, become confused. For this reason, many elevator owners insist that no more than some small percent (such as two percent) of elevator calls shall be reassigned. However, if the initial assignment is determined to be truly inferior, and there is a much superior choice of a car to answer the call, then the call should be reassigned. In some cases, it is possible that, due to equipment conditions, the call would never be answered by the assigned car.

It has been known to examine assigned call criteria, and if the predicted waiting time exceeds an "elderly" threshold, such as 45 seconds, and there is another car that could possibly reach the call in a much shorter time, such as ten seconds, then reassignment of the car is made. On the other hand, when a call's PWT is slightly below the threshold, (e.g., PWT=40 seconds), the call will not be considered for reassignment, even though an excellent candidate car exists for reassigning. The problem is that this excellent candidate car may very well have passed right by the call, for instance, some 6 seconds from now when the PWT exceeds the threshold.

DISCLOSURE OF INVENTION

Objects of the invention include elevator car dispatching employing reevaluation of hall call assignments by methods which include fuzzy logic expressions of the predicted length of time for cars to answer calls, and a hall call reassignment system which can easily be tailored to suit the desired response and reassignment characteristics of a given group of elevators, in terms of the nature of traffic therein, the required passenger satisfaction, and the intended stability of initial hall call assignments.

According to the present invention, the predicted time for a currently assigned car to answer a hall call is looked up in a fuzzy set, and if the resulting membership value indicates a sufficiently long waiting time, the remaining time for other cars to respond to the call are looked up, and if sufficiently short, the difference in remaining time between the assigned car and another car is looked up in the fuzzy set. If the resulting membership of the difference indicates a great difference, then a weighted summation of the memberships in a predicted call waiting time being LONG fuzzy set, another car being capable of responding in a SMALL time fuzzy set, and the difference in car response times being GREAT fuzzy set may cause reassignment of the hall call.

In one embodiment of the invention, the maximum amount by which the predicted waiting time for the call if assigned to any of the other cars is increased over the predicted waiting time for the currently assigned car to answer the call is also looked up in the fuzzy set. Then, the weighted summation of the memberships of all the fuzzy sets is generated to provide an eligibility factor for each of the other cars whose membership values have exceeded individual thresholds. Then, the car having the maximum eligibility factor is assigned the call provided it exceeds a threshold.

In another embodiment, if the weighted summation of the LONG, SMALL, and GREAT fuzzy sets for any car exceeds a threshold, the call is reassigned to some car using the ordinary, new hall call assignor routine.

According further to the invention, the process is performed only on fully loaded cars which have no intervening car calls and for calls which have been registered for a while. In accordance further with the invention, calls assigned to a delayed car may be reassigned if the predicted total delay exceeds an elderly threshold.

According further to the invention, all of the foregoing processes are allowed to occur only once, and will not result in the assignment if the call has already been assigned one time.

In further accord with the invention, calls can be reassigned to a car that happens to show up at the call floor, or when an assigned car is no longer in the group.

The invention allows not only comparing the expected speed with which the currently-assigned car will reach a call, with the expected speed with which another car can answer the call, it also allows tailoring through weighted memberships and fuzzy sets, to suit the desired response and reassignment characteristics of the elevator system. The system thereby finds a true balance between a bad assignment and a better assignment, and the need to make as few reassignments as possible. The invention is easily implemented utilizing apparatus and technology which are well within the skill of the art, in the light of the teachings which follow hereinafter.

Other objects, features and advantages of the present invention will become more apparent in the light of the following detailed description of exemplary embodiments thereof, as illustrated in the accompanying drawing.

BEST MODE FOR CARRY OUT THE INVENTION

Figure 1A:
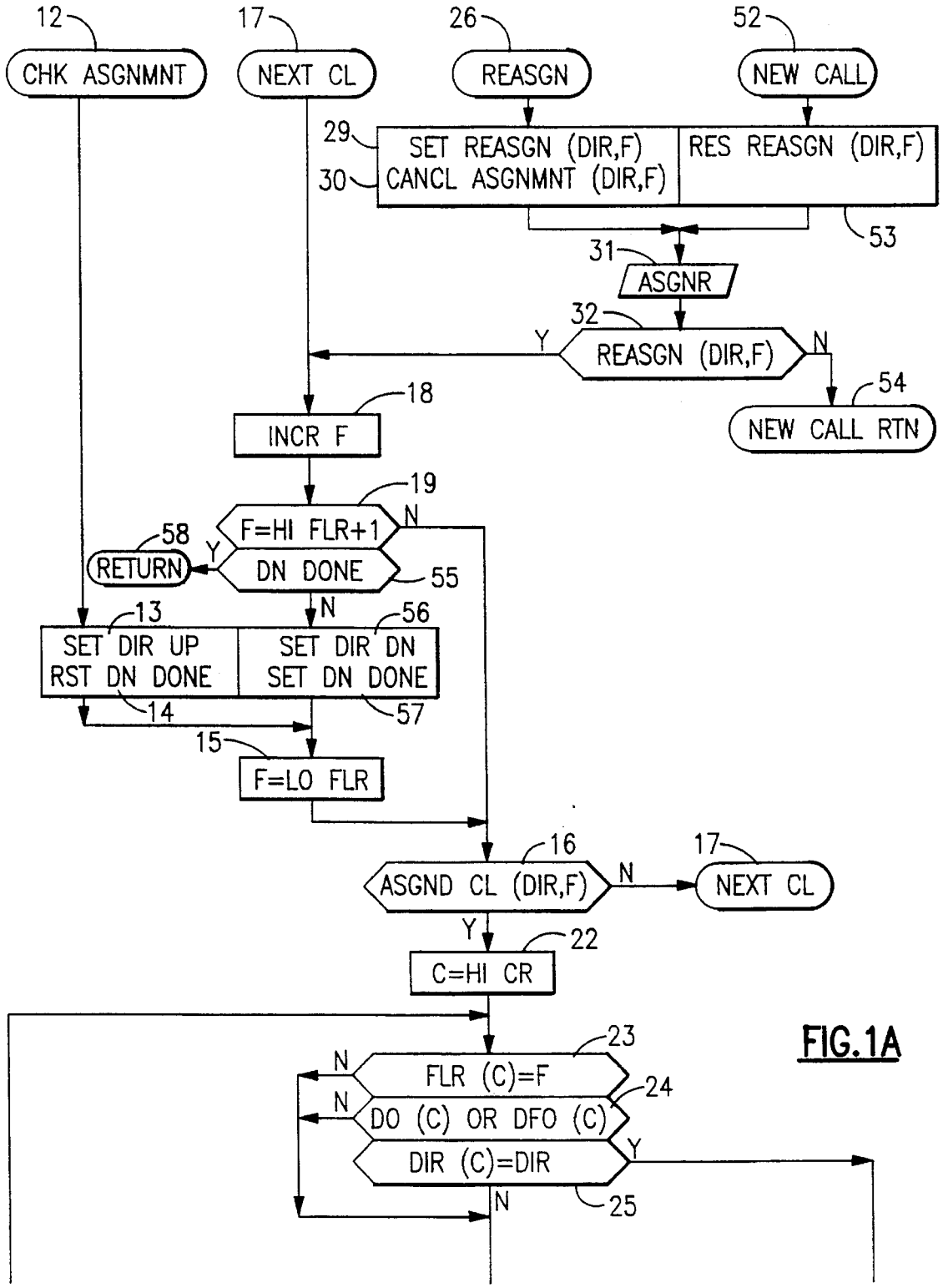
FIG. 1 is a logic flow diagram of a portion of a check assignment routine.
Figure 1B:
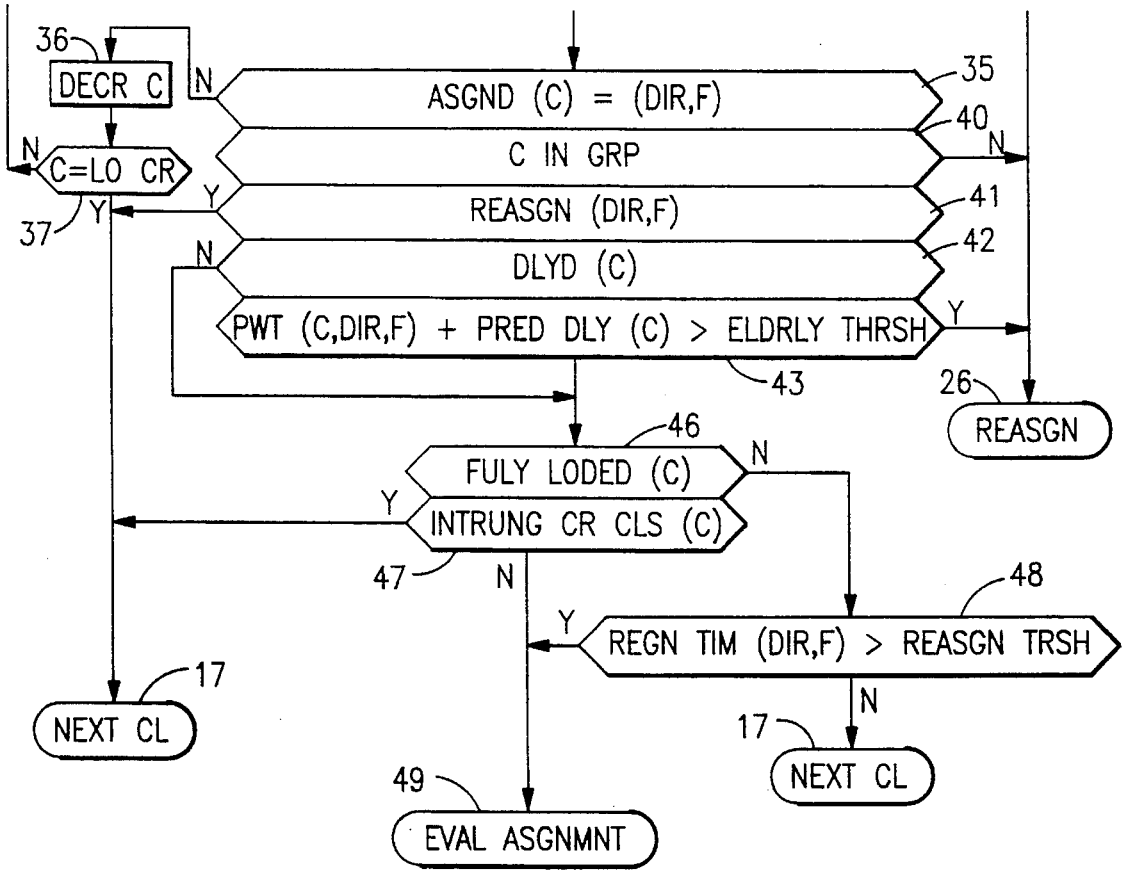
Figure 1:
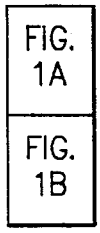

Referring now to FIG. 1, a check assignment routine may be part of an overall dispatching system of the type which performs a variety of control functions in addition to actual assignment of newly made hall calls to cars for service. At some point in such a dispatching routine, the check assignment routine of FIG. 1 may be reached through an entry point 12 to determine if any of the assignments which have previously been made have become inappropriate for any of a variety of reasons, or simply because of delay in response of the assigned car. Each time that the check assignment routine is reached, a first step 13 sets the direction of the program (not of an elevator) to be up, so that all up hall calls can be checked in sequence, to see if any should be reassigned. And a flag used locally in the routine of FIG. 1 called "down done" is reset in a step 14. Then a floor counter, F, is set to the lowest floor of the building in a step 15 and a test 16 determines if there is an assigned call in the current direction at the present floor under consideration. If there is not, a negative result of step 16 reaches a next call transfer point 17 which causes the routine to prepare, at the top of FIG. 1, to see if there is an assigned up call on the next higher floor in the building. A step 18 increments the F counter to the next floor, and a test 19 determines if the F counter is now pointing to the highest floor in the building, plus one, indicating that all the floors have been examined for up hall calls. Initially, this will not be the case so the test 16 is reached again to see if there is an assigned call in the up direction at the present floor. If there is, a car counter, C, is set equal to the highest car in the building in a step 22. This counter is used to examine each car that might have been assigned to the call in the processes which follow. A test 23 determines if the floor of the car is at the floor, F, of the call under consideration. If it is, a test 24 determines if either the door has been commanded to open, or is fully open. If it is, then a test 25 determines if the direction of the car is the same as the direction of call being considered. If all of tests 23–25 are affirmative, this means there is a car at the floor heading in the right direction and passengers waiting for a car will enter this car, thereby servicing the call. For that reason, an affirmative result of test 25 will reach a transfer point 26 which, at the top of FIG. 1, will cause the call to be reassigned. Regardless of the reassignment process, it is hard to imagine that the call would not be reassigned to the car standing at the door. Bear in mind that these processes take a fraction of a second, and therefore the reassignment will be complete before the doors of the car begin to close or the like. However, another method of handling the unexpected car situation of tests 23–25 is to force an unassignment of the call at floor F within all of the cars of the system, and cancelling the call request, rather than using the assignor routine to do those tasks.

If reassignment is to occur, a step 29 will set the reassignment flag for the call in question, so that the call would not thereafter be reassigned once again, as described hereinafter. And a step 30 will cancel the assignment of this call to whatever car it was assigned to. Then a subroutine 31 will assign the call to a suitable car and a test 32 determines if the reassignment flag of step 29 is set, or not, to determine why the assignor routine was performed and thereby determine how the program should proceed. In this case, a reassignment has been performed so an affirmative result of test 32 reaches step 18 to once again increment the floor counter to look at the next call in turn. Assuming test 19 is negative and test 16 is affirmative, the step 22 will once again set C equal to the high car to examine the next hall call. Assuming that car C is not at the floor of the call, or that either of the tests 24, 25 are negative, a test 35 determines if the car being considered has in fact been assigned the call under consideration. If it has not, a negative result of test 35 reaches a step 36 to decrement the C counter and a test 37 determines if the C counter now indicates the lowest numbered car in the group, or not. In the general case, test 37 should always be negative since every call should be assigned to some car, so the situation of test 37 being positive should never be reached. However, to prevent program lockup, an affirmative result of test 37 will reach the next call transfer point 17 to evaluate the next call in turn, as described hereinbefore. In the normal case, test 37 is negative returning to test 23 to see if the next lower car of the group is at the floor of the hall call, etc.

If tests 23–25 are negative (the car is not answering the call) and test 35 is affirmative, the car has the call of interest assigned to it, then a test 40 determines if the car is still in the group. If this car is no longer in the group, it will never answer the call, so a negative result of test 40 reaches the reassignment transfer point 26 to cause the call to be reassigned as described hereinbefore. Then, through the steps and tests 29–32 at the top of FIG. 1, step 18 is reached to look at the next call in question. Each time that another floor is indicated by step 18, all of the cars are reevaluated with respect to such call due to the step 22. Assuming the routine passes through all of the steps 23–25, 35 and 40 described hereinbefore, it will reach a test 41 to determine if the particular hall call has been reassigned once already, as indicated in the step 29 described hereinbefore. If it has, then the remaining considerations of criteria under which the call might be reassigned are bypassed, because an affirmative result of test 41 will reach the transfer point 17 to advance the routine to the next call in question. This means that the two conditions– a car traveling in the right direction showing up at the call floor (tests 23–25 being affirmative) and the car to which the call is assigned being no longer in the group– will cause reassignment of the call even if it has been reassigned before, because such is necessary. But, the remaining portion of the check assignment routine of FIGS. 1 and 2, however, are bypassed without any chance of reassigning the call if the call has already been reassigned one time.

If the call has not been reassigned, a test 42 determines if the car is delayed. A delayed car is one having doors that will not now close, for one reason or another. If the car in question is delayed, an affirmative result of test 42 will reach a test 43 to determine if the summation of the predicted waiting time for this car to answer this call (which is, as described hereinafter, the registration time of the call so far summed with the remaining response time of this car to answer the call) and the predicted delay of the car exceeds an elderly threshold (such as 60 seconds or the like). An affirmative result of test 43 will reach the reassignment transfer point 26 to have this call assigned to some other car. If the car is not delayed, a negative result of test 42 reaches a step 46 to determine if the car is fully loaded. If it is, a test 47 determines if there are intervening car calls between the present position of the car in question and the floor of the hall call being considered, which is defined herein to include a car call at the floor of the hall call, F. If there are intervening calls, then passengers will get off so the fact that the car is presently fully loaded is not important, and an affirmative result of test 47 will reach the next call transfer point 17 to examine the next call in turn, without reassigning this call. If the car is not fully loaded, then the call itself is examined to see if its registration time exceeds a small, reassignment threshold, such as 20 seconds or so; if it has not, there is no need to do all the processing since the call need not be reassigned, and a negative result of test 48 reaches the next call transfer point 17 to cause the next call in turn to be examined without reassigning this call. But if the call has been there a while or if the car is fully loaded without intervening car calls, then an evaluate assignment transfer point 49 is reached. This causes a second portion of the check assignment routine to be reached in FIG. 2.

At the top of FIG. 1, a new call entry point 52, a step 53, the test 32, and a new call return point 54 illustrate that when reassignment occurs (if it does) in accordance with the invention, ordinary assignment takes place, in the same fashion as for a new call. This is within the assignor routine 31. Further, the fact that there is a reassignment flag for each call, so that it will only be reassigned once, requires that the reassignment flag be reset in the step 53 whenever a floor and direction is assigned as a new call. When the assignor routine 31 is shared by both reassignment and new calls, the step 32 causes the routine to revert to either the reassignment task or the new call task, as is appropriately designated by the reassignment flag. Thus, if the assignor routine is reached through the step 29, test 32 will be affirmative but if it is reached through the step 55, test 32 will be negative. And each time that a call is reassigned, the affirmative result of test 32 reaches the step 18 to increment the floor counter, F, and test 19 determines if the highest floor in the building has already had its call in a given direction examined, or not. If not, the next call is handled; but if so, an affirmative result of test 19 reaches a test 57 to determine if the down direction has been done yet; initially it will not have been, so a negative result of test 55 will reach a step 56 where the direction is set to down, and the down done flag is set in a step 57. Then, the process is reinitiated by step 15 setting the floor counter, F, to the lowest floor of the building, and the process continues for down hall calls in the same fashion as described with respect to up hall calls, hereinbefore. Eventually, the down hall calls on every floor will have been examined, so that when step 18 increments the floor counter to a number higher than the highest floor in the building, there will once again be an affirmative result of test 19, and this time, since the down done flag was set in the step 57, an affirmative result of test 55 will reach a return point 58, to cause the processor to revert to some other part of its program. The processor will then perform any other appropriate dispatching, car control, cab control or other functions.

Figure 2A:
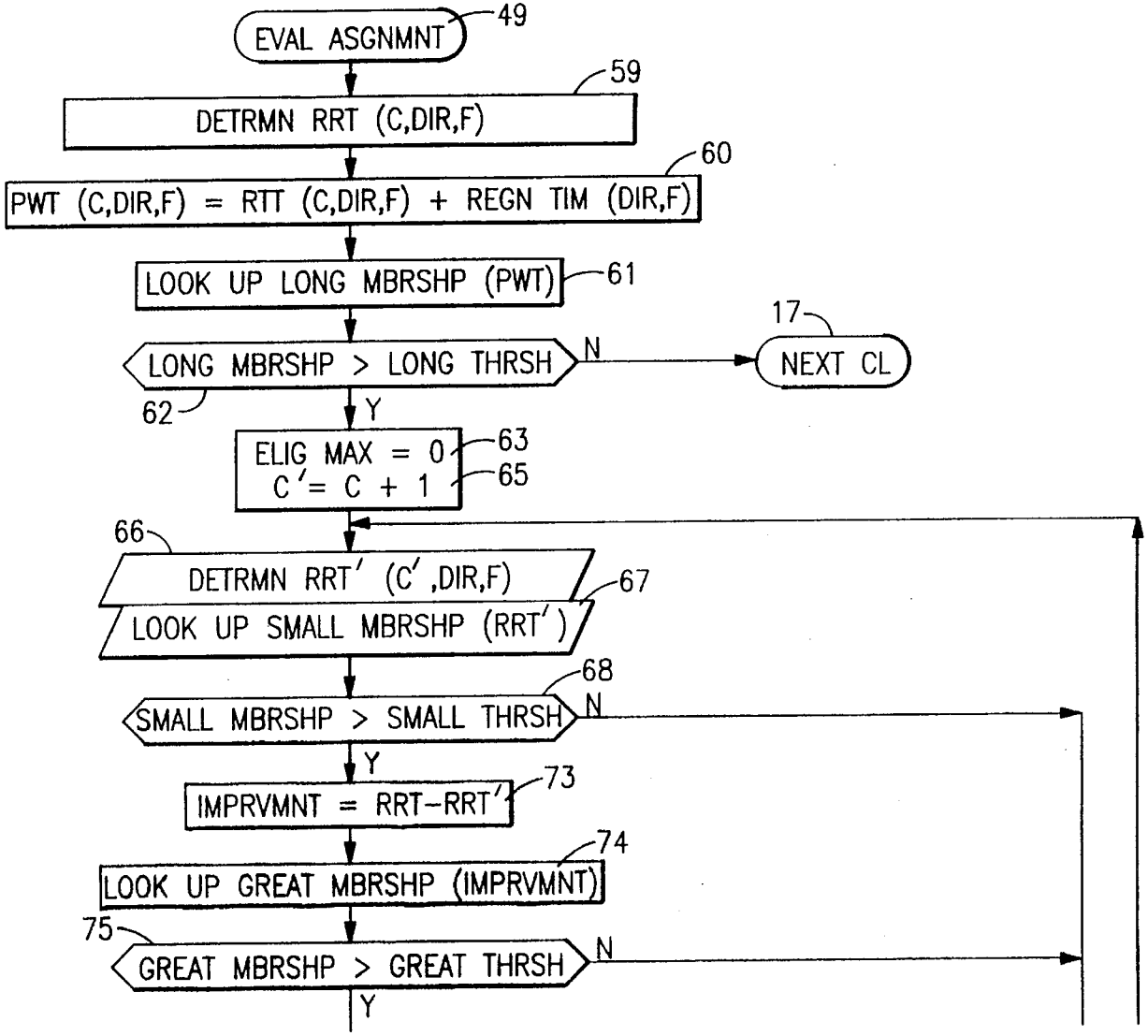
FIG. 2 is a logic flow diagram of another portion of the check assignment routine of FIG. 1 in which assignments are evaluated using fuzzy logic.
Figures 2, 2B:
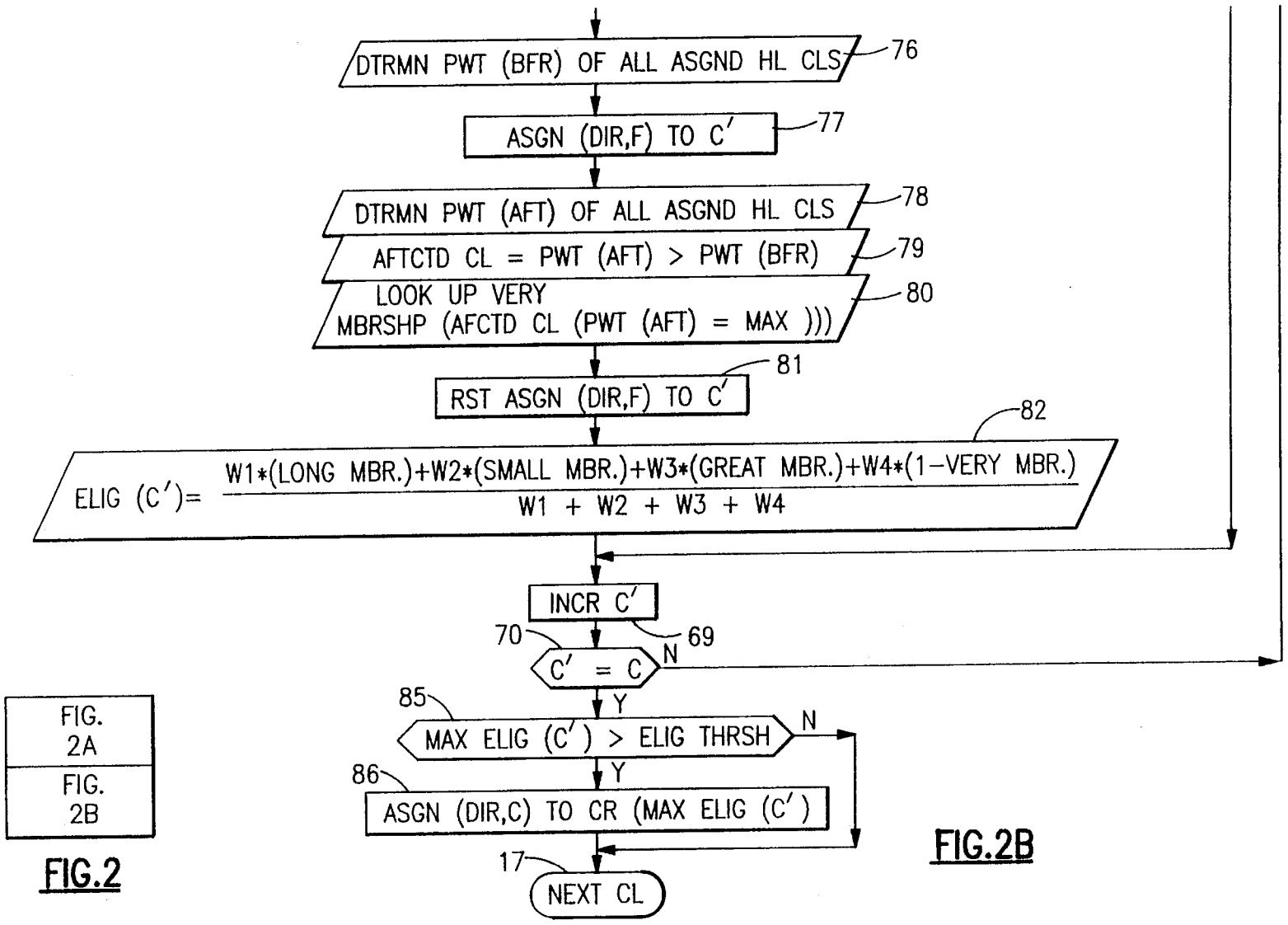
Figure 3:
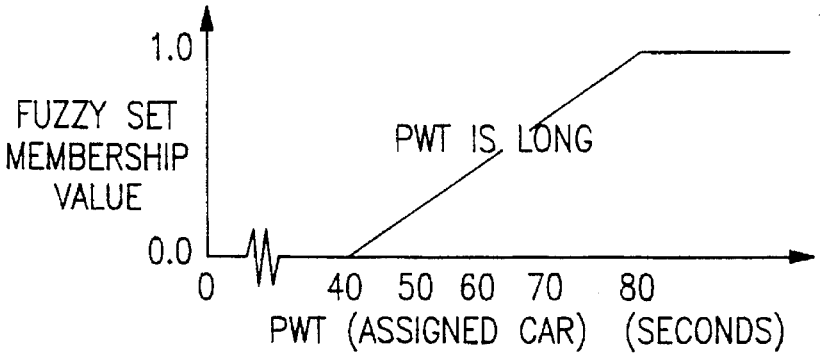
FIG. 3 is a chart illustrating a fuzzy set indicating the degree to which the predicted waiting time of a call assigned to a car is deemed to be a long time.

In FIG. 2, a subroutine 59 determines the remaining response time (RRT) for car C to answer a call in the direction under consideration at floor F (the hall call being checked for reassignment). The estimated remaining response time is simply a function of where the elevator is, the distance it must travel, how many stops it must make, and to allow for doors to open, doors to close, and passenger movement time, all as is known in the art. Then, a step 60 provides the predicted waiting time (PWT) for car C to answer the call which is the summation of the remaining response time prediction and the registration time (age) of the call so far. If the predicted waiting time is very long, then perhaps the call should be reassigned. In accordance with the invention, the degree to which the predicted waiting time is deemed to be long is set forth in a fuzzy set, such as the example illustrated in FIG. 3. Thus, instead of saying that anything more than 60 seconds is too long, we can say that there is an unsuitability about long waiting times which we can take into consideration with other factors. The membership of the predicted waiting time in the fuzzy set LONG (FIG. 3) is looked up in a subroutine 61. Then a test 62 determines if the membership in the LONG fuzzy set exceeds a LONG threshold, which can be established in any elevator group to tailor the reassignment function to suit the desired response characteristics of the group. As an example, the LONG threshold may simply be any non-zero number (e.g., LONG MBRSHP>0), or it could be a small number like 10 or 15. If the threshold is not reached, a negative result of test 62 reaches the next call transfer point 17 so as to take up the next call in turn without having reassigned this call.

Figure 4:
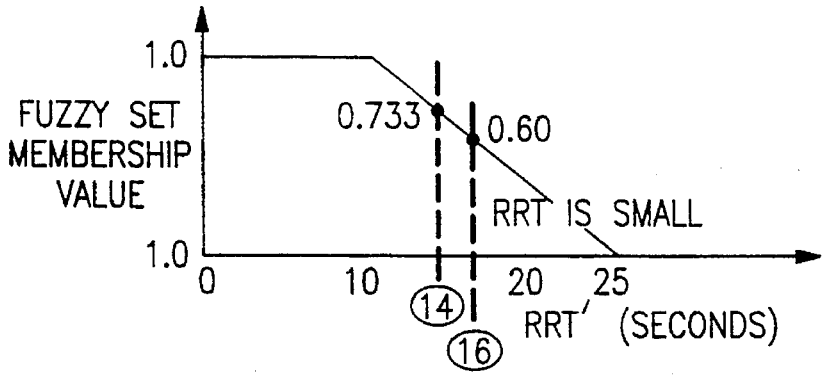
FIG. 4 is a chart illustrating a fuzzy set indicating the degree to which the estimated time for another car to reach an unanswered call is deemed to be small.

If the threshold is exceeded, an affirmative result of test 62 reaches a step 65 in which a local car counter C' is set equal to one more than the number of the car in question. This allows comparing estimates of the time it will take this car to reach this call with estimates of the time it will take any other car to reach the call. The subroutine 66 determines the remaining response time (RRT') of the next higher numbered car, C' then the car in question for the current call (DIR,F). To see if this response time should be deemed to be small, a subroutine 67 looks up the remaining response time for this next car in a SMALL fuzzy set, such as the example illustrated in FIG. 4. In the example of FIG. 4, a basis element of 14 seconds will yield a membership value of 0.733; a basis element of 16 seconds will yield a membership value of 0.60. Then a test 68 determines if the membership value in the SMALL fuzzy set exceeds a SMALL threshold, which may be simply non-zero, or some small number. If it does not, a negative result reaches a step 69 where C' is incremented to point to the next car in the group, and a test 70 determines if all of the cars except car C have been passed through this loop or not. Initially, they will not have, so a negative result of test 70 reaches the subroutine 66 to determine the remaining response time of the next car in turn.

Figure 5:
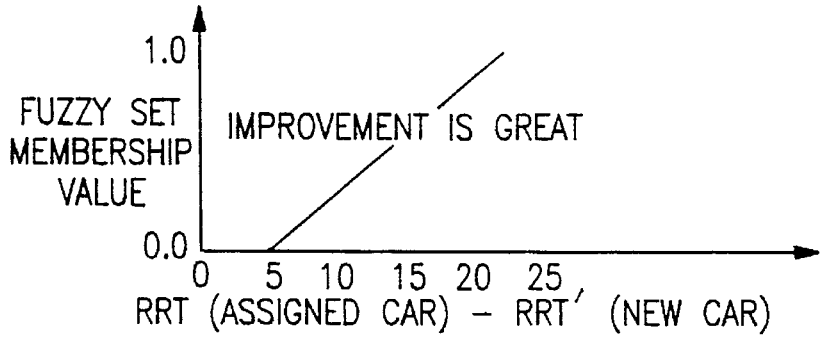
FIG. 5 is a chart illustrating a fuzzy set indicative of the degree to which the improvement of a new assignment over an old assignment is deemed to be great.

Eventually, there may be a car whose membership in the SMALL fuzzy set exceeds the SMALL threshold, in which case a step 73 is reached in which the remaining response time of the car which just passed the SMALL threshold test (RRT') is subtracted from that of the car which currently is assigned the call in question (RRT), to determine the response time improvement which might result by transferring the call to the new car. This improvement is then used as a basis element to look up, in a subroutine 74, a membership value in a GREAT fuzzy set, such as the example shown in FIG. 5. And, the membership value of the GREAT fuzzy set is compared against a GREAT threshold in a test 75. The GREAT threshold may just be any non-zero number, or it could be a small number. If the membership is not non-zero (or at least as high as the threshold), a negative result of test 75 reaches the step and test 69 and 70 to determine if the program should revert for testing another car, or not. If all of the other cars failed the threshold test, eventually C' will equal C, meaning all the cars except the car in question have been tested, and an affirmative result of test 70 will reach the next call transfer point 17 to test the next call in question, without having reassigned the present call. But if the GREAT membership for this car, C', exceeds the GREAT threshold, an affirmative result of test 25 reaches a portion of the routine which determines if assignment of the call to car C' will have an undue adverse affect on the hall calls already assigned to various cars.

Figure 6:
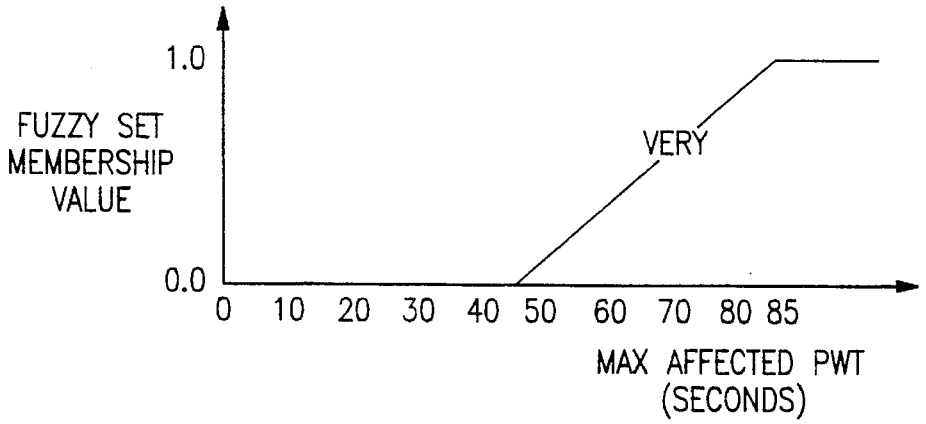
FIG. 6 is a chart illustrating a fuzzy set indicative of the degree to which assignment of this call to another car will adversely affect already-assigned hall calls.

A subroutine 76 determines the predicted waiting time, identified as "before" of all assigned hall calls except the call under consideration. Then, the call under consideration is temporarily assigned to car C' in a step 77. And then a subroutine 78 determines predicted waiting time, identified as "after", of all assigned hall calls except the call in question. And then for all of the assigned calls, a subroutine 79 determines if it is an effected call by virtue of its predicted waiting time after the assignment exceeding the predicted waiting time before the assignment. Next, a subroutine 80 looks up the membership of the one of the affected calls for which the affected call of subroutine 79 is in a VERY fuzzy set (indicating very affected), such as the example illustrated in FIG. 6. Then, a step 81 resets the assignment of the call under consideration to car C'. In a subroutine 83, which provides an eligibility for the car, ELIG(C'), as the normalized, weighted summation of the four membership values LONG, SMALL, GREAT and VERY. The weighting factors for each of the memberships can be tailored in any elevator group so as to suit the response characteristics intended for that group. As an example, in a given group, if great improvement is twice as important as short response time of a new car, long predicted waiting time of the current assignment, or adverse affect on other cars, then the weighting factors of the subroutine 84 may be, for instance, W1=1, W2=1, W3=2, and W4=1. Being normalized (divided by the summation of the weighting factors), the eligibility will be (like the membership values) a number between 0 and 1. Then the step 69 increments C' and the test 70 determines if all of the other cars have had an opportunity to participate in reassignment, or not. If not, the routine reverts to the subroutine 66 to examine the next car in turn. When all of the cars have been eliminated in either the tests 68 or 75, or had the eligibility determined, an affirmative result of test 70 will reach a test 85 in which the maximum eligibility is compared with an eligibility threshold which may, for instance, be on the order of 0.6 or 0.8. If the eligibility exceeds an eligibility threshold, an affirmative result of test 85 will reach a step 86 to assign the call in question to the car having the maximum eligibility. However, if the maximum eligibility does not exceed the threshold, a negative result of test 85 bypasses the step 86 so that the program will advance to consider the next call through the transfer point 17 without assigning the call.

Figure 7:
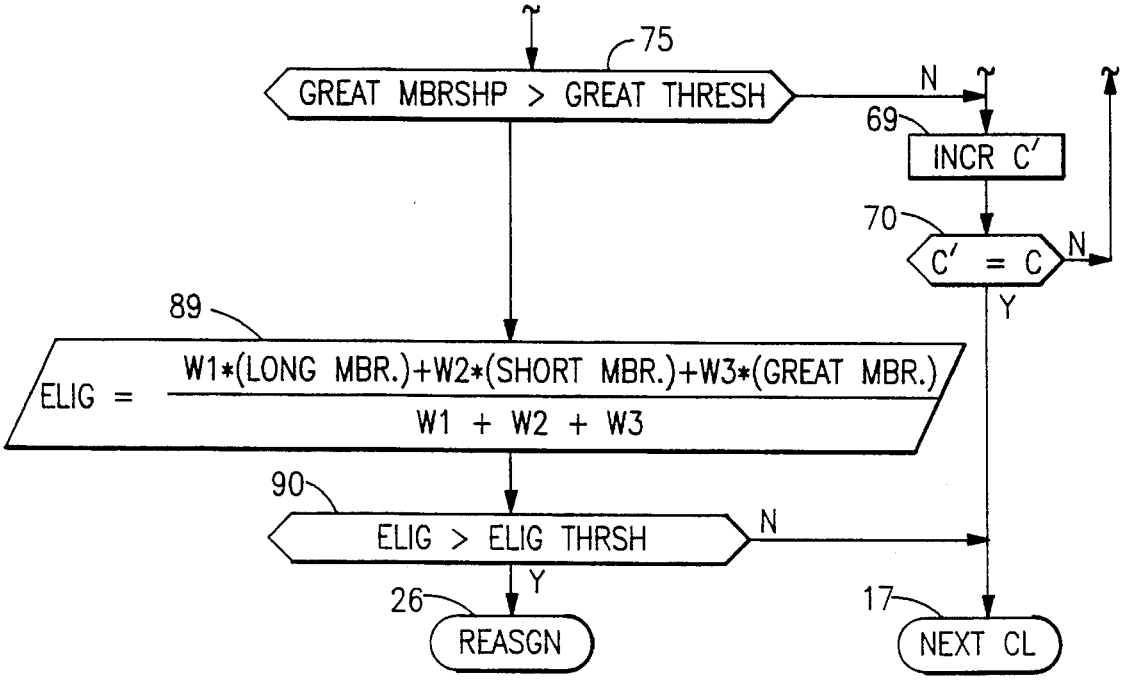
FIG. 7 is a partial logic flow diagram of an alternative, simpler embodiment.

An alternative embodiment of the invention is illustrated in FIG. 7 wherein if, in the upper part of FIG. 2, the current assignment is deemed long enough (test 62) and there is another car which can get to the call in a sufficiently short time (test 68) and the improvement using this other car is great enough (test 75), then the eligibility of the car, C' is determined in a subroutine 89, without considering affects on other cars. Then a test 90 determines if the eligibility determined for this car in the subroutine 89 exceeds an eligibility threshold. If it does, an affirmative result of test 90 reaches the reassignment point 26 to cause the call to be reassigned in the manner described with respect to FIG. 1 hereinbefore. In this embodiment, FIG. 7 simply determines that there is a candidate car available, and therefore it makes sense to reassign it. However, the assignor routine may find a car that, all in all, under the scheme of reassignment, reassigns the call to a car other than the one which passed the test 90.

Another embodiment of the invention is that of FIG. 2 but without using the subroutines and steps 76–81, and eliminating the fourth weighted term in the subroutine 82; this may be effected by simply letting W4=0; in that case, the call is reassigned (if at all) to the car with the highest weighted combination of SMALL and GREAT. Of course, all the weighting can be ONES, or the weight factors eliminated altogether, in any of the embodiments.

Of course, normalization is not required in the subroutines 84, 89 if the threshold is adjusted accordingly, which may be preferred to save processing time. All of the numbers, including the exemplary sets of FIGS. 3–5 and the exemplary thresholds, may be altered in a wide variety of ways so as to provide various elevator group responses, as desired. Of course, certain features of the invention can be utilized with or without other features of the invention.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of dispatching a group of elevator cars in a building including a process for reassigning a hall call from a first car to a second car under certain conditions, comprising:

(a) determining the estimated remaining response time for the first car to answer said call;

(b) determining the predicted waiting time for said call as the summation of said remaining response time and the time since said call was registered;

(c) providing a fuzzy set having basis elements indicative of said predicted waiting time and membership values indicative of the degree to which said predicted waiting time is deemed to be a long waiting time;

(d) determining the predicted remaining response time for said second car to respond to said call;

(e) providing a fuzzy set having basis elements indicative of said predicted remaining response time and membership values indicative of the degree to which said predicted remaining response time is deemed to be a small time;

(f) determining an improvement as the difference in time between said estimated remaining response time of said first car and said predicted remaining response time of said second car;

(g) providing a fuzzy set having basis elements indicative of said improvement and membership values indicative of the degree to which said improvement is deemed to be great;

(h) providing actual membership values from related ones of said fuzzy sets corresponding to said predicted waiting time, said predicted remaining response time, and said improvement, respectively:

(i) selectively reassigning said call from said first car to said second car in response to said membership values; and (j) dispatching elevator cars in said building to service hall calls assigned to said cars.

2. A method according to claim 1 wherein said hall call is not reassigned from said first car to said second car if one of said actual membership values is less than a corresponding threshold magnitude.

3. A method according to claim 2 wherein said hall call is not reassigned from said first car to said second car unless all of the said actual membership values exceed respectively corresponding threshold values.

4. A method according to claim 1 including:

weighting at least one of said membership values different than at least another of said membership values;

providing the summation of said membership values as weighted; and selectively reassigning said hall call from said first car to said second car in response to said summation.

5. A method according to claim 4 wherein said hall call is reassigned from said first car to said second car if said summation exceeds a threshold value.

6. A method according to claim 1 including:

weighting at least one of said membership values different than at least another of said membership values;

providing the summation of said membership values as weighted; and leaving said elevator hall call assigned to said first car if said summation is less than a threshold value.

7. A method according to claim 1 including:

if said hall call is reassigned from said first car to said second car, blocking said process so said hall call is not reassigned from said second car to a third car.

8. A method of dispatching a plurality of elevator cars operating as a group in a building including a process for reassigning hall calls from a first car to a second car under certain conditions, comprising:

for a hall call, registered at a given floor of a building for travel in a certain direction, assigned to a first one of said cars, reassigning said hall call from said first car to a second one of said cars when said second car is at said floor with its doors open or opening and having a travel direction the same as said certain direction.

9. A method of dispatching a plurality of elevator cars operating as a group in a building including a process for reassigning hall calls from a first car to a second car under certain conditions, comprising:

for a hall call, registered at a given floor of a building for travel in a certain direction, assigned to only a first one of said cars, cancelling said call and the assignment of said hall call to said first car when a second one of said cars is at said floor with its doors open or opening and having a travel direction the same as said certain direction.

10. A method according to claim 1 including:

if said first car is delayed and the predicted total delay in answering the call exceeds a threshold, if said first car is fully loaded with no intervening car calls between said first car and said hall call, or if said hall call has been registered for at least a threshold extent of time, then selectively reassigning said hall call from said first car to a second one of said cars based on the relative estimated time of response of said first and second cars to said hall call, otherwise, not reassigning said hall call from said first car to another car.

11. A method according to claim 10 wherein said hall call is selectively reassigned by the steps of:

(a) determining the estimated remaining response time for the first car to answer said call;

(b) determining the predicted waiting time for said call as the summation of said remaining response time and the time since said call was registered;

(c) providing a fuzzy set having basis elements indicative of said predicted waiting time and membership values indicative of the degree to which said predicted waiting time is deemed to be a long waiting time;

(d) determining the predicted remaining response time for said second car to respond to said call;

(e) providing a fuzzy set having basis elements indicative of said predicted remaining response time and membership values indicative of the degree to which said predicted remaining response time is deemed to be a small time;

(f) determining an improvement as the difference in time between said estimated remaining response time of said first car and said predicted remaining response time of said second car;

(g) providing a fuzzy set having basis elements indicative of said improvement and membership values indicative of the degree to which said improvement is deemed to be great;

(h) providing actual membership values from related ones of said fuzzy sets corresponding to said predicted waiting time, said predicted remaining response time, and said improvement, respectively:

(i) selectively reassigning said call from said first car to said second car in response to said membership values; and (j) dispatching elevator cars in said building to service hall calls assigned to said cars.

12. A method of dispatching a group of elevator cars in a building including a process for reassigning a given hall call from a first car to a second car under certain conditions, comprising:

(a) determining the estimated remaining response time for the first car to answer said given call;

(b) determining the predicted waiting time for said given call as the summation of said remaining response time and the time since said given call was registered;

(c) providing a fuzzy set having basis elements indicative of said predicted waiting time and membership values indicative of the degree to which said predicted waiting time is deemed to be a long waiting time;

for each other car in the group (d) determining the predicted remaining response time for said other car to respond to said given call;

(e) providing a fuzzy set having basis elements indicative of said predicted remaining response time and membership values indicative of the degree to which said predicted remaining response time is deemed to be a small time;

(f) determining an improvement as the difference in time between said estimated remaining response time of said first car and said predicted remaining response time of said other car;

(g) providing a fuzzy set having basis elements indicative of said improvement and membership values indicative of the degree to which said improvement is deemed to be great;

(h) determining the affected predicted waiting time for each already-assigned hall call to be answered if said given call is assigned to said other car and determining the amount by which said affected predicted waiting time exceeds the predicted waiting time for such already-assigned call if said given call remains assigned to said first car;

(i) providing a fuzzy set having basis elements indicative of the affected predicted waiting time of the call having the maximum amount of excess and membership value indicative of the degree to which assignment of said given call to said other car adversely affects said already-assigned call;

(j) providing actual membership values from related ones of said fuzzy sets corresponding to said predicted waiting time, said predicted remaining response time, and said improvement, and said affected predicted waiting time, respectively:

(k) providing an eligibility factor for said other car in response to said actual membership values; and then (1) selectively reassigning said hall call from said first car to the one of said other cars having the maximum eligibility factor.

13. A method according to claim 12 wherein said hall call is reassigned from said first car to said another car if said maximum eligibility factor exceeds a, threshold value.

14. A method according to claim 1 including:

weighting at least one of said membership values different than at least another of said membership values;

and providing said eligibility factor as the weighted summation of said membership values.

* * * * *